United States Patent [19]

Morrill

[11] 3,951,611

[45] Apr. 20, 1976

[54] BLANK FOR FAN BLADE

[76] Inventor: Wayne J. Morrill, 3448 S. Washington Road, Fort Wayne, Ind. 46804

[22] Filed: Nov. 14, 1974

[21] Appl. No.: 523,652

[52] U.S. Cl. ..... 29/190; 416/223 R; 416/234; 416/243

[51] Int. Cl.[2] ..... F01D 5/14

[58] Field of Search ..... 29/180 A, 190; 416/223, 416/234, 243

[56] References Cited

UNITED STATES PATENTS

| | | | |
|---|---|---|---|
| 1,688,809 | 10/1928 | Gill | 416/223 X |
| 2,023,111 | 12/1935 | Alsing | 416/234 X |

*Primary Examiner*—Arthur J. Steiner

[57] ABSTRACT

A one-piece blank for a propeller fan having a plurality of substantially identical blade portions extending outwardly from a central hub portion, each of the blade portions having leading and trailing edges which are joined at outer leading and trailing corners to an outer peripheral edge. The leading and trailing edges of adjacent leg portions define a narrow radially extending slot and the leading edges are shorter than the trailing edges. Each peripheral edge has a trailing portion extending from the trailing corner which is generally arcuate and a leading portion smoothly joined to the trailing portion and extending to the leading corner which generally follows an involute curve.

10 Claims, 2 Drawing Figures

BLANK FOR FAN BLADE

BACKGROUND OF THE INVENTION

1. Field of the Invention

This invention relates generally to propeller fans, and more particularly to a one-piece blank for a propeller fan.

2. Description of the Prior Art

Propeller fans for air moving applications are commonly formed from a one-piece blank of relatively thin sheet metal, the blank and formed fan having a plurality of blade portions which extend outwardly from a central hub portion by which the fan blade is mounted on a driving member. A wide variety of blade configurations has been proposed for improving the efficiency of air delivery and/or reducing blade noise, it being well known that the noise generated by a propeller fan is affected by the number of blades, the contour and form of the individual blades, the outside diameter of the fan and the velocity of rotation.

SUMMARY OF THE INVENTION

It is desirable in the design of blanks for propeller fans to provide blades of such contour as to produce minimum noise consistent with the efficient delivery of air. Experiments both under laboratory conditions and in practical applications have shown that for blowing air against an appreciable static head, the blades of a one-piece fan should have as little space as possible between the trailing edge of one blade and the leading edge of the adjacent blade; by keeping the frontal area of the fan as free as possible of large openings between the blades, backward leakage of pressurized air and consequent power-consuming turbulance are minimized along with the noise-producing pulses of individual blades. Thus, in my improved fan blade blank, the material removed between successive fan blades by the blanking die is held to a minimum consistent with a satisfactorily strong die.

Furthermore, tests have shown that most of the blade noise of a fan is produced by the leading edge. It is therefore important to design the leading edge of a blade so as to cause minimum air disturbance. It is also known that the largest radius produces the greatest noise. In my improved fan blade blank, the radius of the leading corner is reduced with respect to the radius of the trailing corner thus greatly reducing the noise produced at that point. Finally, in my improved fan blank blank, the peripheral edge of the blade increases in radius from the leading corner to the maximum radius generally along an involute curve thus increasing the radius quickly and uniformly.

I have found that fan blades contoured in accordance with the foregoing principles generate less noise and deliver appreciably more air with less driving power than prior blades of the same diameter rotated at the same speed.

The invention, in its broader aspects, provides a one-piece blank for a propeller fan formed of relatively thin sheet metal and having a plurality of substantially identical blade portions extending outwardly from a central hub portion, each of the blade portions having leading and trailing edges with respect to a predetermined direction of rotation of the fan about an axis extending through the hub portion. The leading and trailing edges of each blade portion are joined at outer leading and trailing corners to an outer peripheral edge, the leading and trailing edges of adjacent blade portions defining a narrow slot therebetween which extends generally radially with respect to the axis, the leading edges being shorter than the trailing edges. Each peripheral edge has a trailing portion which extends from the trailing corner and which is generally arcuate with respect to the axis, and a leading portion which is smoothly joined to the trailing portion and extends to the leading corner and which generally follows an involute curve having a base circle concentric with the axis.

It is accordingly an object of the invention to provide an improved one-piece blank for a propeller fan which, when formed provides a fan which operates at increased efficiency with less noise.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
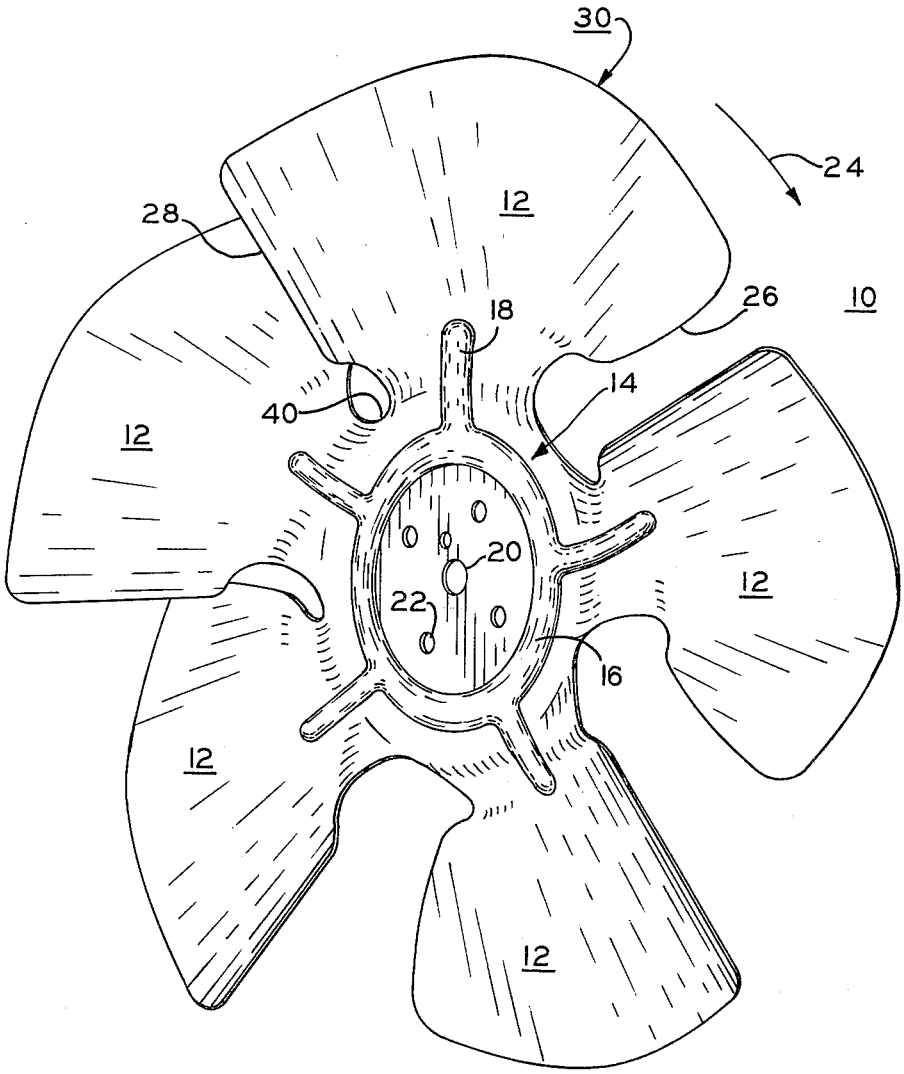
FIG. 1 is a view in perspective showing a propeller fan formed from the improved one-piece blank of the invention.

Referring now to FIG. 1, there is shown a fan blade, generally indicated at 10, formed from the one-piece blank of the invention. Fan 10 is shown as having substantially identical five blade portions 12 respectively extending outwardly from central hub portion 14. During forming of blade 12 from the blank, annular and radially extending rib portions 16, 18 are formed in order to strengthen the blade. Hub portion 14 has center hole 20 formed therein for centering the blade on the driving shaft and additional holes 22 made be provided for centering or driving purposes. Typically, hub portion 14 of blade 10 is mounted directly on an end of the rotor member of the driving motor in order to provide for rapid dissipation of heat from the rotor to the hub and to blades 12. When rotated by the driving motor (not shown) in the direction shown by arrow 24, each blade 12 has leading and trailing edges 26, 28 joined by peripheral edge 30.

Figure 2:
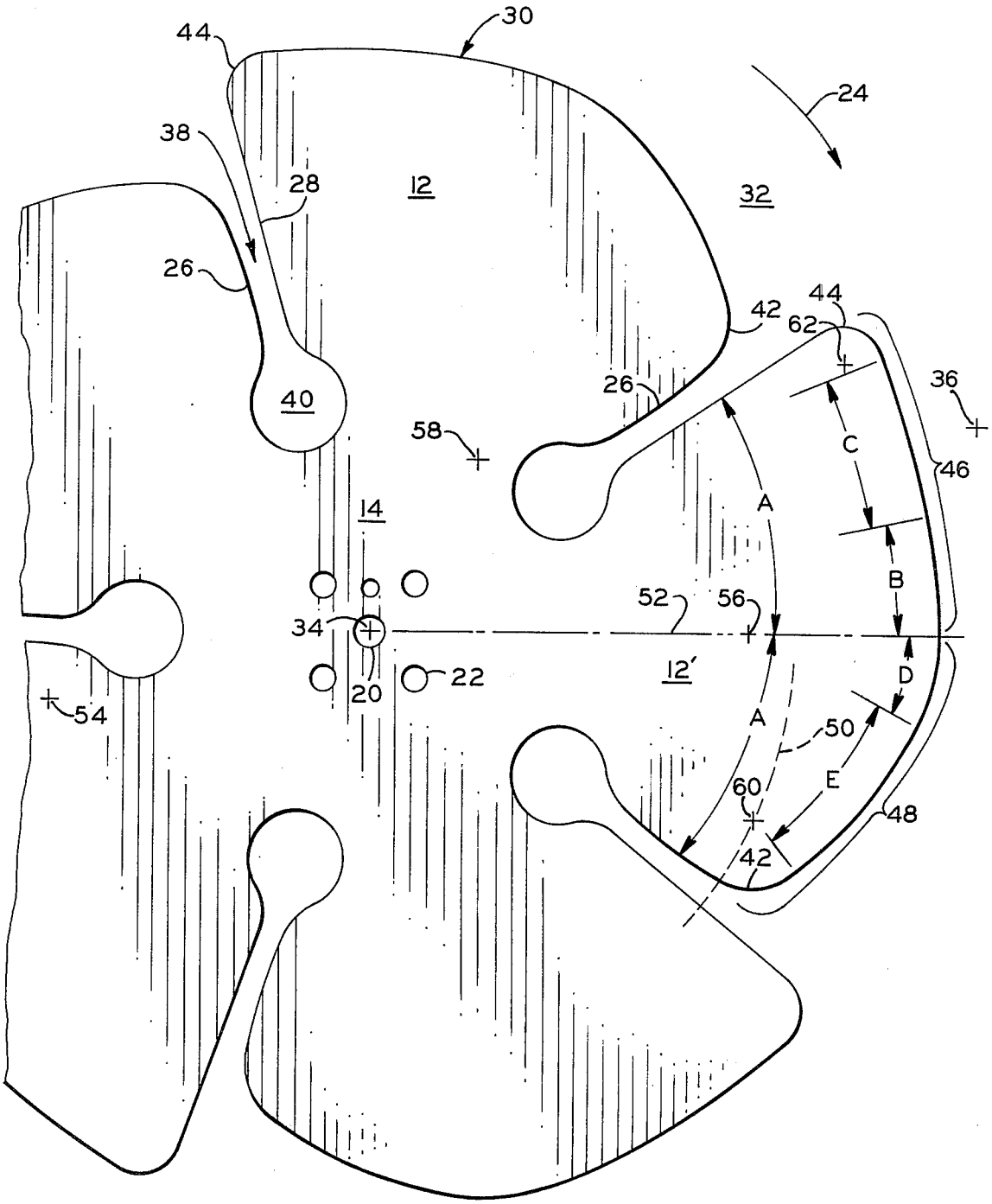
FIG. 2 is a fragmentary plan view of the improved fan blade blank of the invention.

Referring now to FIG. 2 which is drawn closely to scale, there is shown the one-piece blank 32 from which blade 10 is formed. Blank 32 is punched from suitable relatively thin sheet metal. In the illustrated embodiment blank 32 is formed from 0.038 inch aluminum sheet.

Each trailing edge 28 extends radially with respect to central axis 34 of hub portion 14 while each leading edge 26 is slightly curved on a radius extending from a point outside of the circle of blades 12, as at point 36 in the case of blade 12'. In the illustrated embodiment, leading edge 26 has a radius of 4.0 inches. Leading and trailing edges 26, 28 of adjacent blades 12 define narrow, generally radially extending slots 38, therebetween, slots 38 having a width at their narrowest point of 7/32 inch in the illustrated embodiment. The inner ends of slots 38 terminate in enlarged, generally circular openings 40 to provide a region at the base of each blade 12 to permit twisting the blade during the forming operation. In the illustrated embodiment, aperatures 40 have a radius of .38 inch.

Leading and trailing edges 26, 28 of each blade 12 are joined by rounded, leading and trailing corners 42, 44 to peripheral edge 30. In accordance with the invention, leading edge 26 of each blade 12 is shorter than trailing edge 28. In the illustrated embodiment, the radius at each leading corner 42, taken from axis 34 to dashed line 50, is about 75% of the radius at each trailing corner 44, taken from axis 34 to peripheral edge 30. Further, and importantly, the outer, peripheral edge 30 of each blade 12 has a trailing portion 46 extending from trailing corner 44 which is generally arcuate with respect to axis 34, and a leading portion 48 which is smoothly joined to trailing portion 46, extends to leading corner 42, and which generally follows an involute curve having a base circle shown in dashed lines at 50 concentric with axis 34. It will be seen that the leading section of the involute curve which forms leading portion 48 of peripheral edge 30 actually forms leading corner 42 of each blade 12. In the preferred embodiment, trailing and leading portions 46, 48 of outer peripheral edge 30 of each blade 12 join at imaginary line 52 which is equallyangularly spaced from leading and trailing edges 26, 28, as shown by angles A in the case of blade 12'. In the illustrated embodiment, angles A are 33° 30'.

In the preferred embodiment, trailing portion 46 of outer peripheral edge 30 of each blade 12 departs slightly from a true arc about axis 34. Trailing portion 46 has a section B extending from line 52 which is a true arc about axis 34, and a section C extending from section B to trailing corner 44 which is arcuate about another axis and has a radius longer than the radius of section B; the radius of section C has an axis which is displaced from axis 34 as shown at 54 in the case of blade 12'. In the illustrated embodiment, the radius of section B taken from axis 34 is 4.45 inches while the radius of section C taken from axis 54 is 7.0 inches.

It is of course very difficult to produce a punching die having a true involute curved section therein and thus, in the preferred embodiment, leading portion 48 of outer peripheral edge 30 of each blade 12 comprises arcuately curved section D extending from line 52 and having a radius extending from point 56 on line 52 in the case of blade 12', arcuately curved section E extending from section D to a leading section 42 and having a radius extending from point 58 in the case of blade 12', and arcuately curved leading section 42 having a radius extending from point 60 in the case of blade 12'. In the illustrated embodiment, section D has a radius of 1.50 inches, section E has a radius of 4.0 inches, and section 42 has a radius of 0.5 inch. Trailing corner 44 of each blade 12 is arcuately curved about point 62 in the case of blade 12' and, in the illustrated embodiment, has a radius of 0.31 inch. In the illustrated embodiment, the circle of blades 12 has an outside diameter of 8.9 inches and the five blades are equally spaced at 72°.

As mentioned above, leading portion 48 of outer peripheral edge 30 of each blade 12 approximates an involute curve. An involute curve has the unique property of acting like a uniform-rise cam and thus, if an involute is rotated about the center of its base circle in the direction to enlarge the involute, the rise of the involute per revolution along a line tangent to the base circle is equal to the circumference of the base circle. Because of this characteristic, leading portion 48 of outer peripheral edge 30 of each blade 12 is formed to generally an involute curve until the maximum radius is reached at which point the contour of the peripheral edge changes to generally arcuate until the trailing corner of the blade is reached. Fan blades formed from blanks incorporating the invention have been found to provide an approximately 10% improvement in air delivery and an approximately 30% reduction in driving horsepower with an appreciable reduction in noise.

While there have been described above the principles of this invention in connection with specific apparatus, it is to be clearly understood that this description is made only by way of example and not as a limitation to the scope of the invention.

What is claimed is:

1. In a one-piece blank for a propeller fan formed of relatively thin sheet metal having a plurality of substantially identical blade portions extending outwardly from a central hub portion, each of said blade portions having leading and trailing edges with respect to a predetermined direction of rotation of said fan about an axis extending through said hub portion, said leading and trailing edges of each of said blade portions being joined at outer leading and trailing corners to an outer peripheral edge, the improvement wherein the leading and trailing edges of adjacent blade portions define a narrow slot therebetween which extends generally radially with respect to said axis, said leading edges being shorter than said trailing edges, each said peripheral edge having a trailing portion extending from said trailing corner which is generally arcuate with respect to said axis and a leading portion smoothly joined to said trailing portion and extending to said leading corner which generally follows an involute curve having a base circle concentric with said axis.

2. The blank of claim 1 wherein said involute curve has a leading section which forms said leading corner of each said blade portion.

3. The blank of claim 2 wherein the radius from said axis of each said blade portion at said leading corner is about 75% of the radius from said axis at said trailing corner.

4. The blank of claim 1 wherein there are an odd number of said blade portions.

5. The blank of claim 4 wherein there are five of said blade portions.

6. The blank of claim 1 wherein each of said trailing edges extends radially with respect to said axis, each of said leading edges being slightly curved.

7. The blank of claim 1 wherein said leading and trailing portions of each said peripheral edge join at an imaginary line extending radially from said axis and which is generally equally angularly spaced from the respective leading and trailing edges.

8. The blank of claim 7 wherein a first section of said trailing portion of each said peripheral edge which extends from said line is formed as substantially a true arc about said axis, the remaining section being arcuate with a radius longer than the radius of said first section.

9. The blank of claim 1 wherein there are an odd number of said blade portions, each said involute curve having a leading section which forms said leading corner of the respective blade portion, the radius from said axis of each said blade portion at said leading corner being about 75% of the radius from said axis at said trailing corner, each of said trailing edges extending radially with respect to said axis, each of said leading edges being slightly curved, said leading and trailing portions of each said peripheral edge joining at an imaginary line extending radially from said axis which is generally equally angularly spaced from the respective leading and trailing edges.

10. The blank of claim 9 wherein said leading and trailing corners are rounded, said trailing corners have a radius less than that of said leading corners.

* * * * *